US006047882A

United States Patent [19]

Sin et al.

[11] Patent Number: 6,047,882

[45] Date of Patent: Apr. 11, 2000

[54] BOX BLANKS CONTAINING EASY-OPEN TABS

[76] Inventors: Woo H. Sin; Anne K. Sin, both of 14213 Cribbage Terr., Silver Spring, Md. 20904

[21] Appl. No.: 09/215,390

[22] Filed: Dec. 18, 1998

Related U.S. Application Data

[63] Continuation-in-part of application No. 09/166,743, Oct. 5, 1998

[60] Provisional application No. 60/096,941, Aug. 18, 1998.

[51] Int. Cl.[7] ..... B65D 43/08

[52] U.S. Cl. ..... 229/125.32; 229/125.39; 53/136.4; 493/382

[58] Field of Search ..... 53/133.7, 134.1, 53/136.4, 484; 493/59, 382; 229/125.39, 125.19, 125.26–125.32

[56] References Cited

U.S. PATENT DOCUMENTS 4,889,581 12/1989 Ulrich et al. ..... 53/136.4
5,039,005 8/1991 Flaming ..... 493/382
5,079,900 1/1992 Pinckney et al. ..... 53/136.4
5,184,997 2/1993 James et al. ..... 53/136.4

*Primary Examiner*—Eugene Kim
*Attorney, Agent, or Firm*—Richard L Huff

[57] ABSTRACT

A method of making a box blank, the blank, and the resulting box are disclosed. The box contains a tab for simplifying the opening of the box once it is taped shut in the usual manner. The tab contains an adhesive upper portion and a non-adhesive lower portion. When the box is taped shut, the tape covers a portion of the tab. The tab is pulled up, releasing the adhesive portion of the tab and the adhered tape. By further pulling, the entire tape may be removed. The tab may be opened and closed repeatedly. A part of the adhesive portion of the tab may be scored and treated with a more adherent adhesive to provide tampering detection. The side of the box may be scored or scored and cut to form a tab. The adhesive sealing tape covers a portion of the tab. The tab may be pushed in to allow grasping and removal of the tape or the tab may be pulled out to allow removal of the tape. Holes are placed on the side of the box and are partially covered by tape, allowing grasping of the end of the tape and removal of the tape by pulling.

20 Claims, 4 Drawing Sheets

BOX BLANKS CONTAINING EASY-OPEN TABS

CROSS-REFERENCE TO RELATED APPLICATIONS

This application is a continuation-in-part of co-pending application U.S. Ser. No. 09/166,743 filed Oct. 5, 1998 and claims the effective filing date of provisional application Ser. No. 60/096,941 filed Aug. 18, 1998.

BACKGROUND OF THE INVENTION

1. Field of the Invention

This invention is directed to box blanks and boxes having tabs attached thereto which will allow for simple opening and resealing of the boxes when the boxes have been sealed with adhesive sealing tape.

2. Description of the Related Art

It is common knowledge in the art that conventional boxes contain four sides having upper and lower edges, a bottom, and a top having a center line and containing two inner flaps and two outer flaps. For convenience, and to acknowledge that the two flaps are not always of the same width, this center line will be referred to as the joining line throughout this specification. The outer flaps come into close proximity with each other near the joining line when the boxes are closed. In order to seal such boxes, a strip of strong, sometimes reinforced, adhesive sealing tape is applied. This tape generally runs from a point near the top of one side, along the joining line of the top, and down the opposite side to a point near the top of that side. In many instances, a plurality of strips are applied to add additional strength to the seal. It is also conventional to seal boxes by causing tape to go from one side of the box to the other, passing perpendicular to the joining line. Conventionally, both ends of the tape are firmly adhered to the sides of the boxes. Opening the boxes by lifting the tape is extremely difficult and time-consuming. Therefore, clerks, stock personnel, or other end users resort to opening the boxes by cutting the tape with a variety of cutting devices. These cutting devices have sharp edges, which are dangerous to carry or to leave lying around. These cutting devices are also easy to lose. Until now, there has been no simple way to open boxes sealed as described above or to be able to open and reseal the boxes a multiplicity of times. Additionally, At times it is important to determine if a sealed box has been previously opened following the initial sealing. Using conventional sealing tape, there is no way to make this determination.

SUMMARY OF THE INVENTION

This invention seeks to solve the above-described problems by preparing boxes which contain tabs which will allow for easy opening and resealing of the sealed boxes. The tabs are composed of upper adhesive and lower non-adhesive portions. The adhesive portions are adhered to the boxes by means of a known adhesive which will allow for release and resealing. The lower non-adhesive portions serve as handles. The tabs are placed on box blanks in such a way that they will be along a continuation of the joining line or in another position which will be at the end of the sealing tape. Thus, the tabs may be at the top of a side of a box, between the top and bottom of a side of a box, or even on the bottom surface of a box. Preferably, the tabs are applied to the box blanks following construction and printing of the blanks and before the blanks are packaged for shipment. The tabs may be applied to box blanks after manufacture, to boxes following assembly, or, in some instances, may be incorporated in the sealing tape and applied at the time of sealing the box. One of the tabs of the present invention contains an inner portion which adheres to the side of a box more strongly than does the outer portion of the tab. When the tap is pulled away in the process of unsealing the box, the inner portion of the tab remains on the box side. The act of separating the outer portion from the inner portion of the tab for the first time causes a characteristic snapping sound enabling the user to determine whether the box has previously been opened.

DESCRIPTION OF THE PREFERRED EMBODIMENTS

The invention will now be described with reference to the above drawing, like numerals referring to like features throughout.

Figure 1:
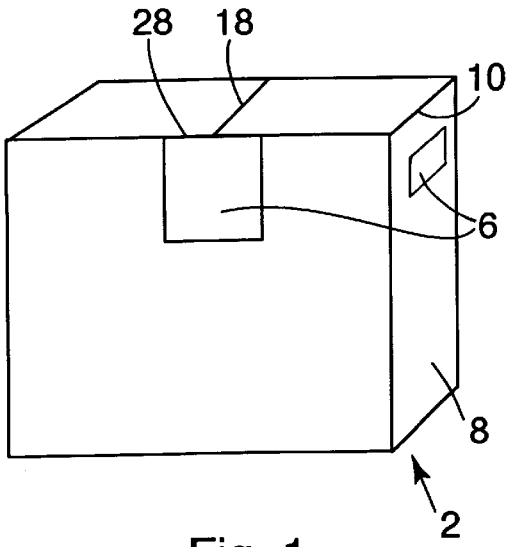
FIG. 1 is an elevational perspective view of a box having a tab of the present invention attached thereto at the top of a side.
Figure 4:
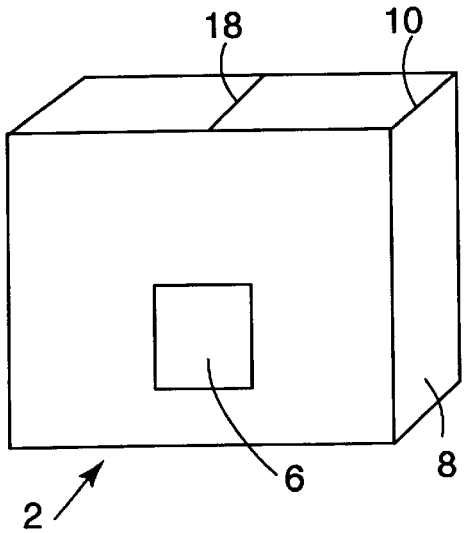
FIG. 4 is an elevational perspective view of a box having a tab of the present invention attached thereto at the center of a side.
Figure 5:
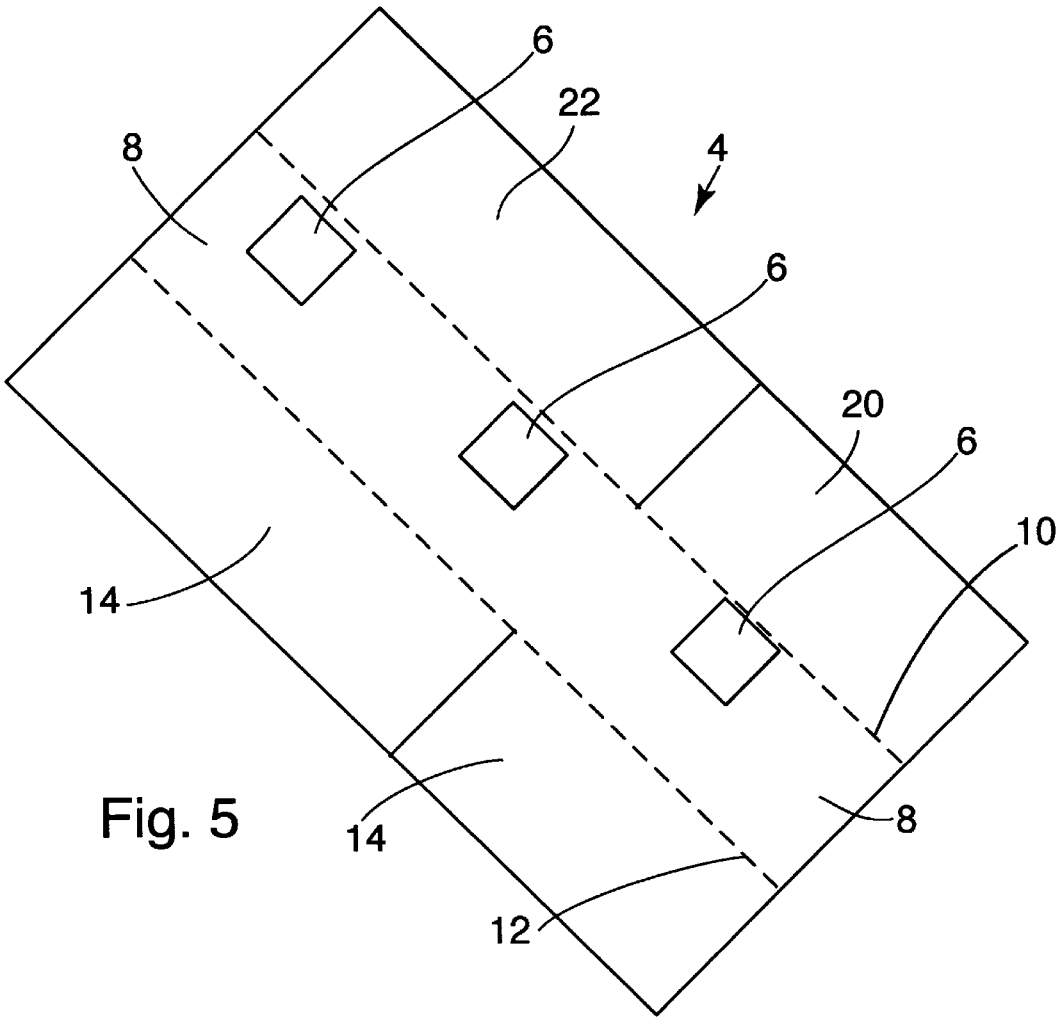
FIG. 5 is a top plan view of a box blank having tabs of this invention in place.

Referring to FIGS. 1, 4 and 5, a box 2 and a box blank 4 having a tab 6 attached will be described.

During the manufacture of boxes 2, box blanks 4 are prepared which will result in boxes 2 having the required size and shape. Conventionally, a box 2 has four sides 8 having upper 10 and lower edges 12, a bottom 14, and a top 16 having a joining line 18. The box additionally has two inner flaps 20 and two outer flaps 22. Conventionally, the outer flaps 22 are of equal size and meet at the center along the joining line 18. It is understood, however, that the outer flaps 22 may be of different sizes and the joining line 18 will be to one side or the other of true center.

Following preparation of the blank 4 and before shipping to a company which will be filling the box 2, the box 2 is printed according to the instructions of the filling company.

According to the present invention, a tab 6 is placed on the box 2 at a time following manufacture of the blank 4. This may be prior to or after printing, preferably after printing. The tab 6 may be placed on the box 2 prior to or after shipping, preferably prior to shipping. If desired, the tab 6 may be placed on the box 2 after filling and prior to sealing. In another embodiment, the tab 6 may be put on the box 2 at the time of sealing.

Figure 2:
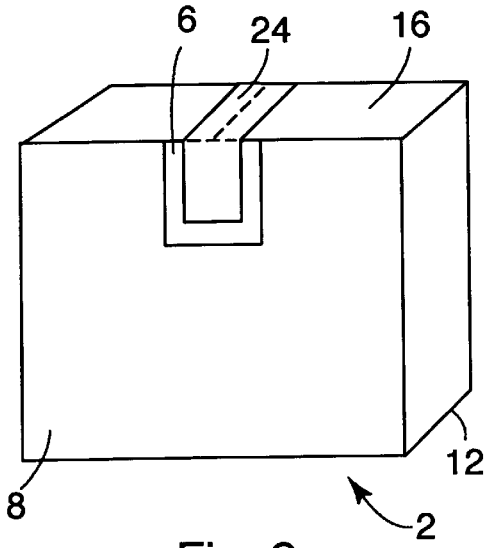
FIG. 2 is an elevational perspective view of a tabbed box according to FIG. 1 with sealing tape in place.

With reference to FIGS. 1, 2 and 4, sealing of the box 2 will be described.

When the box 2 is filled, it is closed by bringing the outer flaps 22 into close proximity with each other at the joining line 18. The box 2 is then taped shut by starting tape 24 along a continuation of the joining line 18 on a first side (not shown) near the top thereof, bringing the tape 24 along the joining line 18 of the top 16 so that it holds down the two outer flaps 22, and bringing the tape 24 down a second side 8 opposite the first side so that it ends on the tab 6 in a continuation of the joining line 18. The tab 6 is preferably placed on the second side 8 near the upper edge 10 or center thereof However, the tab 6 may be placed at any point along a continuation of the joining line 18 including the bottom surface 14 of the box 2. For instances when the box 2 will be sealed by tape 24 running perpendicular to the joining line, the box 2 will contain at least one tab 6 on a side 8 which does represent a continuation of the joining line 18.

The tab 6 of one embodiment of this invention will be discussed with reference to FIGS. 3 and 6–8.

The tab 6 of one embodiment of this invention is constructed so that it has an adhesive portion 26 having an upper edge 28 and a non-adhesive portion 30. In a preferred embodiment, the tab 6 lies along a continuation of the joining line 18 on the side 8 of the box 2 to which the final portion 32 of tape 24 is applied. In one embodiment, the adhesive portion 26 comprises a strip 34, a first side 36 of which has adhesive and a second side 38 of which has no adhesive. The first side 36 containing adhesive is applied to the side 8 of the box 2. The adhesive may be any suitable adhesive known in the art, but is preferably of the type known to be suitable for multiple sealing and release operations. Thus, an adhesive having relatively low adhesive properties is preferred.

Figure 3:
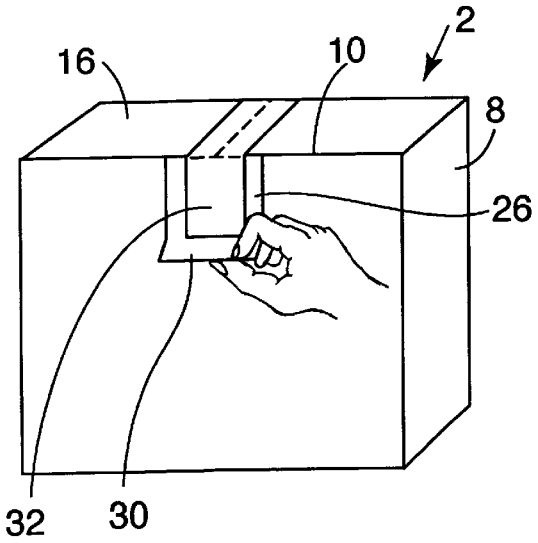
FIG. 3 is an elevational perspective view of a tabbed and sealed box, showing how the tape may be released.
Figure 7:
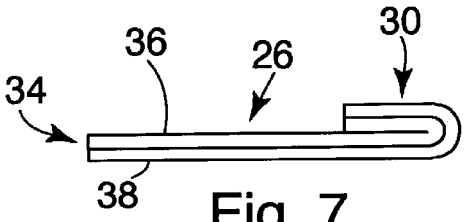
FIG. 7 is a side elevational view of a second embodiment of a tab of this invention.
Figure 6:
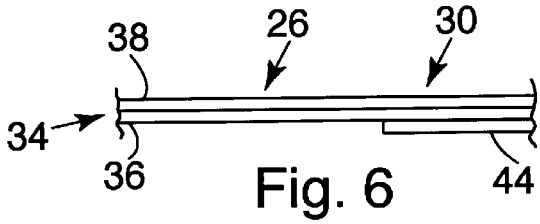
FIG. 6 is a side elevational view of one embodiment of a tab of this invention.
Figure 8:
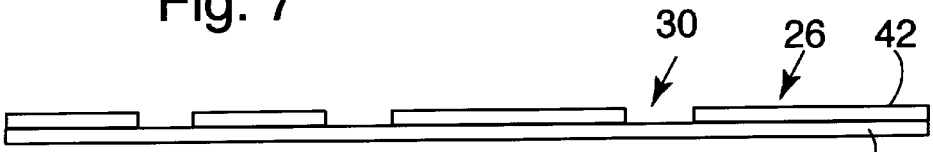
FIG. 8 is a side elevational view of a strip of tabs according to this invention.

The non-adhesive portion 30 of the tab 6 has no adhesive facing the side 8 of the box 2. In constructing the tab 6, a single strip 34 may be used and adhesive 42 may be applied to alternating sections as shown in FIG. 8. Another method of making the tab 6 as shown in FIG. 7 is to prepare an adhesive strip 34 of relatively short length and to fold a portion of the strip 34 upon itself so as to prepare an adhesive portion 26 having exposed adhesive 42 and a non-adhesive portion 30 having no exposed adhesive. A third method of preparing the tab 6 as shown in FIGS. 3 and 6 is to prepare an adhesive strip 34 and to adhere a layer of material 44 to alternating sections of that strip to prepare a strip 34 having alternating sections of exposed adhesive and solid material 44. The material 44 may be of any suitable type, and is preferably cloth, cardboard, or paper.

In another method of this embodiment, the tab 6 may be prepared after filling the box 2 and during the time of sealing. One end of the tape 24 used in sealing the box 2 may be folded back upon itself to prepare a non-adhesive portion or handle 30 as shown in FIG. 7 which is devoid of any exposed adhesive. Thus, the tape 24 and the tab 6 are of one piece. Also, the sealing tape 24 may be adhered to a piece of material 44 which serves as a non-adhesive portion or handle 30 as shown in FIG. 6. Again, cloth, cardboard, and paper are preferred materials 44.

The opening of the sealed box 2 will now be described with reference to FIG. 3.

Following filling of the box 2 and sealing the box 2 so that the adhesive tape 24 from along the joining line 18 of the top 16 is attached to the outer surface of the upper adhesive portion 26 of the tab 6, the adhesive tape 24 may be easily removed without cutting by simply lifting the tab 6. As this is done, the attached adhesive tape 24 is lifted off the side 8 of the box 2. Continued pulling of the handle 30 results in the removal of the tape 24 from the joining line 18 of the top 16 of the box 2.

If desired, the tape 24 may be replaced and the tab 6 re-adhered to the side 8 of the box 2, thus resealing the box 2. This operation may be repeated a multiplicity of times.

Figure 9:
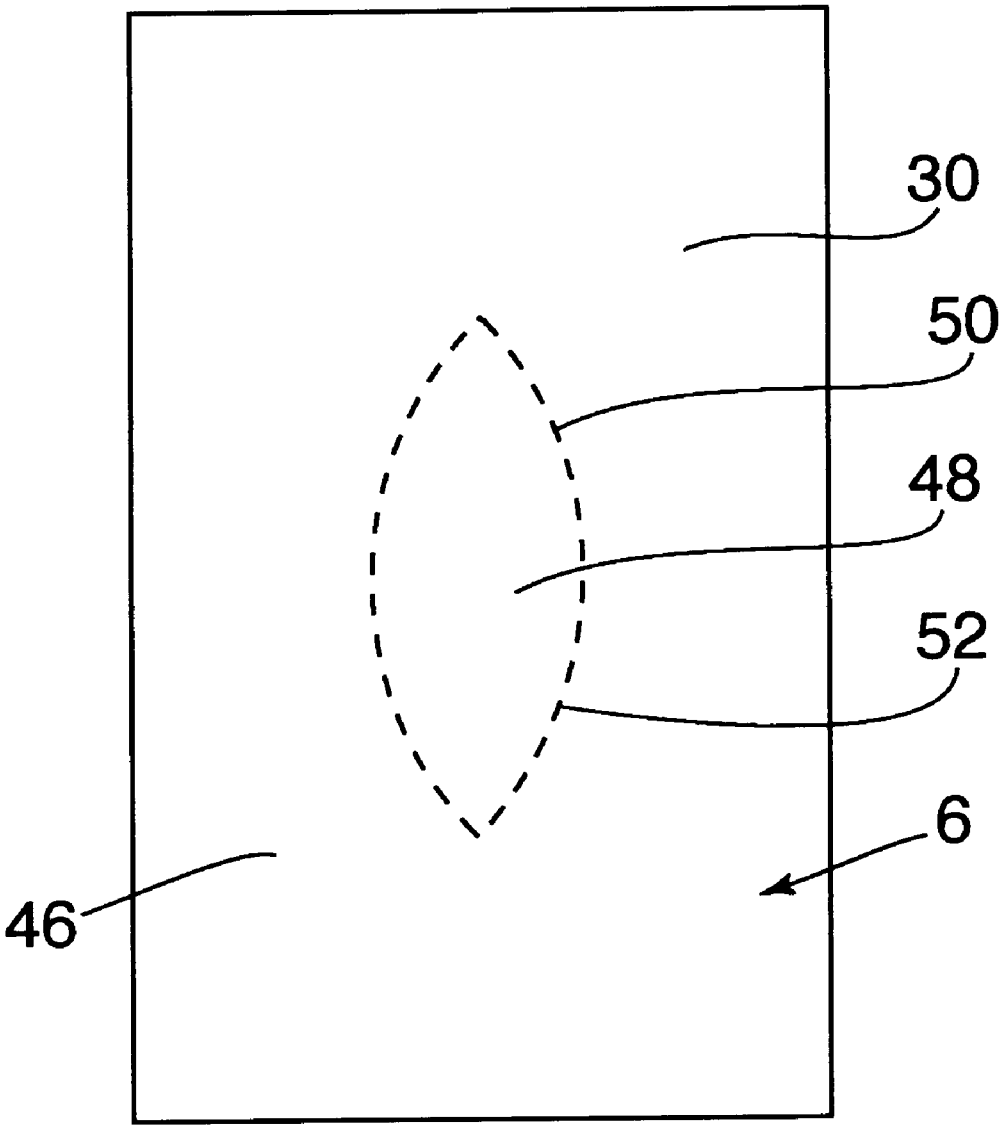
FIG. 9 is a front elevational view of a tab of the present invention having a tamper detection feature according to this invention.

The tab 6 of the just-described embodiment preferably has a tamper detection feature shown in FIG. 9. The tab 6 contains an outer portion 46 and an inner portion 48 prepared by scoring the tab 6 in such a way as to form broad cut lines 50 separated by short connected areas 52. This causes a characteristic snapping or popping sound when the outer portion 46 is pulled away from the inner portion 48. The outer portion 46 is coated on its upper adhesive portion 26 with a lightly adhering adhesive so that the outer portion 46 may be easily pulled away from the box 2. The inner portion 48 is coated on its surface, all of which is in the upper adhesive portion 30 of the tab 6, with a more strongly adhering adhesive so as to remain on the side 8 of the box 2 when the tab 6 is pulled. Thus, upon pulling of the tab 6, the outer portion 46 is removed from the side 8 of the box 2 and removes the sealing tape 24. The inner portion 48 remains adhered to the box 2. The box 2 may be resealed by placing the outer portion 46 of the tab 6 over the inner portion 48. The separation of the outer 46 and inner 48 portions upon pulling the tab 6 produces a characteristic popping sound. In the absence of this sound, the user knows that the box 2 has been previously opened.

Figure 10:
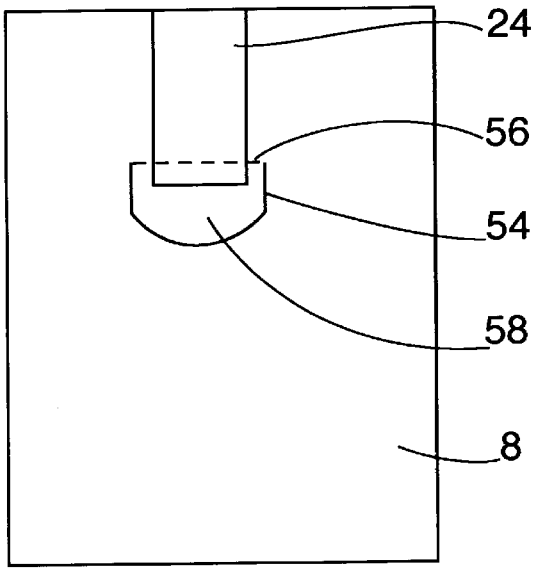
FIG. 10 is a side elevational view of a box having sealing tape in place partially covering a tab having one scored side and three cut sides.

A tab 54 according to another embodiment of this invention will be described with reference to FIG. 10. A side 8 of a box 2 is scored and cut along a continuation of the joining line 18 so as to form a tab 54 shown by a closed outline having a scored line 56 on top and cut lines 58 on three sides. In sealing the box 2, the sealing tape 24 is brought down from the joining line 18 on the top 16 of the box 2 to partially cover the tab 54. The box 2 may be opened by pushing in on the tab 54 so as to produce a free end 32 of the tape 24, this tape 24 may then be grasped and pulled to free the tape 24 from the box 2. Alternatively, the box 2 may be opened by pushing in on the tab 54, grasping the tab 54, and pulling the tab 54 to release the tape 24.

Figure 11:
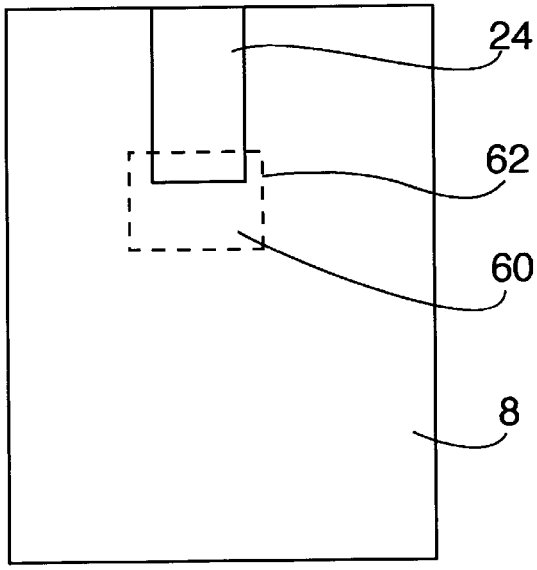
FIG. 11 is a side elevational view of a box having a sealing tape in place partially covering a tab having four scored sides.
Figure 12:
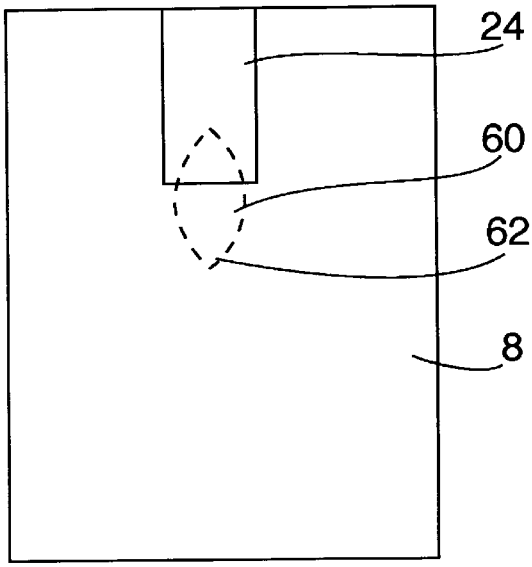
FIG. 12 is a side elevational view of a box having a sealing tape in place partially covering a tab having scored sides forming an alternative shape.

A tab 60 according to a further embodiment will be described with reference to FIGS. 11 and 12. A side 8 of the box 2 is scored along a continuation of the joining line 18 or wherever the tape is intended to end so as to form a tab 60 circumscribed by a closed scored outline 62. In sealing the box 2, the sealing tape 24 is brought down from the joining line 18 on the top 16 of the box 2 to partially cover the tab 60. The box may 2 be opened by pushing in the tab 60 and either grasping and pulling the tape 24 or grasping and pulling the tab 60 to remove the sealing tape 24.

Figure 13:
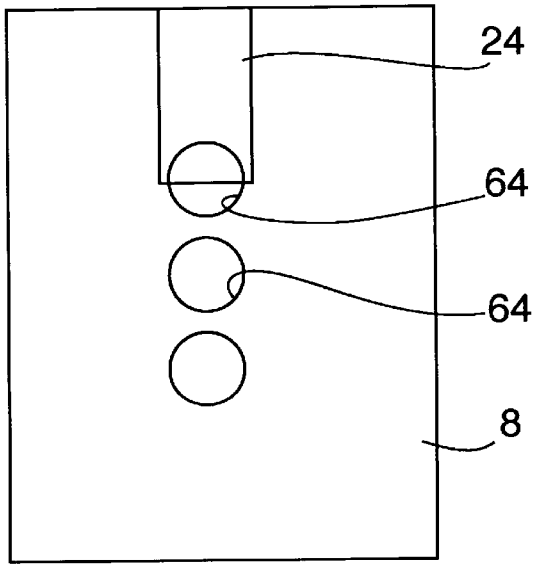
FIG. 13 is a side elevational view of a box having a sealing tape in place partially covering one of a series of holes.

A still further embodiment of the present invention will be described with reference to FIG. 13. At least one hole 64 is cut in the side 8 of a box 2 along the continuation of the joining line 18 or wherever the tape is intended to end. In sealing the box 2, sealing tape 24 is brought down to partially cover one of the holes 64. In removing the tape 24, the free end 32 of the tape 24 is grasped and pulled to easily remove the tape 24.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. In the method of making blanks for boxes which are to be sealed with adhesive sealing tape, which boxes contain four sides having upper and lower edges, a bottom, an inside, an outside, and a top having a joining line and containing two inner flaps and two outer flaps, the outer flaps coming into close proximity at the joining line of the top, the improvement comprising:

A. attaching a tab having an adhesive portion containing adhesive on one side and a non-adhesive portion to a portion of the blank which, when the box is assembled, will be located on the box where an end of adhesive sealing tape will be located;

B. scoring the blank and cutting the blank so that, when the box is assembled, there will be at least one scored line having ends, the ends of which are connected by a cut line which will be located on the box where an end of adhesive sealing tape will be located, which scored line and cut line will form a tab, which tab will be partially covered by the sealing tape which adheres to the tab so that:

i. the tab may be pushed toward the inside of the box and the adhesive sealing tape may be grasped and pulled to open the box or ii. the tab may be pulled toward the outside of the box, freeing the tab from the box and allowing the pulling of the adhesive sealing tape;

C. scoring the blank so that, when the box is assembled, there will be at least one scored line forming a geometric shape which will be located on the box where an end of adhesive sealing tape will be located, which geometric shape will form a tab which will be partially covered by the sealing tape which adheres to the tab so that:

i. the tab may be pushed toward the inside of the box and the adhesive sealing tape may be grasped and pulled to open the box or ii. the tab may be pulled toward the outside of the box, freeing the tab from the box and allowing the pulling of the adhesive sealing tape; or D. cutting at least one hole in the blank so that, when the box is assembled, at least one hole will be located on the box where an end of adhesive sealing tape will be located and will partially cover the hole, thus allowing the adhesive sealing tape to be grasped and pulled to open the box.

2. The method of claim 1, wherein the tab described in (A) is prepared by bending a strip of adhesive tape upon itself to form an adhesive portion containing a single layer of adhesive tape and a non-adhesive portion containing two layers of adhesive tape adhered together.

3. The method of claim 1, wherein the tab described in (A) is prepared by attaching a strip of adhesive tape to at least one layer of material so as to form an adhesive portion containing a single layer of adhesive tape and a non-adhesive portion containing a layer of adhesive tape adhered to at least one layer of material.

4. The method of claim 3, wherein the material is selected from the group consisting of cloth, cardboard, and paper.

5. The method of claim 1, wherein the tab described in (A) contains a scored geometric figure in the adhesive portion, which figure contains a more adherent adhesive than the remaining adhesive on the adhesive portion of the tab.

6. The method of claim 1, wherein the tab described in (A) is attached to the blank such that, when the box is assembled, the tab will be along a continuation of the joining line of the top.

7. The method of claim 1, wherein the scoring and cutting of the blank described in (B) are located such that, when the box is assembled, the cut and scored lines will be along a continuation of the joining line of the top.

8. The method of claim 1, wherein the scoring of the blank described in (C) is located such that, when the box is assembled, the scored lines will be along a continuation of the joining line of the top.

9. The method of claim 1, wherein the hole described in (D) is located such that, when the box is assembled, the hole will be along a continuation of the joining line of the top.

10. In a blank for making boxes which are to be sealed with adhesive sealing tape, which boxes contain four sides having upper and lower edges, a bottom, an inside, an outside, and a top having a joining line and containing two inner flaps and two outer flaps, the outer flaps coming into close proximity at the joining line of the top, the improvement wherein the blank contains:

A. a tab having an adhesive portion containing adhesive on one side and a non-adhesive portion adhered to the blank so that, when the box is assembled, the tab will be located on the box where an end of the adhesive sealing tape will be located;

B. scored lines and cut lines in the blank such that, when the box is assembled, there will be at least one scored line having ends, the ends of which are connected by a cut line which will be located on the box where an end of adhesive sealing tape will be located, which scored line and cut line will form a tab which will be partially covered by the sealing tape which adheres to the tab so that:

i. the tab may be pushed toward the inside of the box, the adhesive sealing tape may be grasped and pulled to open the box or ii. the tab may be pulled toward the outside of the box, freeing the tab from the box and allowing the pulling of the adhesive sealing tape;

C. scored lines in the blank so that, when the box is assembled, there will be at least one scored line forming a geometric shape which will be located on the box where an end of adhesive sealing tape will be located, which geometric shape will form a tab which will be partially covered by the sealing tape which adheres to the tab so that:

i. the tab may be pushed toward the inside of the box and the adhesive sealing tape may be grasped and pulled to open the box or ii. the tab may be pulled toward the outside of the box, freeing the tab from the box and allowing the pulling of the adhesive sealing tape; or D. at least one hole in the blank so that, when the box is assembled, at least one hole will be located on the box where an end of adhesive sealing tape will be located and will partially cover the hole, thus allowing the adhesive sealing tape to be grasped and pulled to open the box.

11. The blank of claim 10, wherein the tab described in (A) is prepared by bending a strip of adhesive tape upon itself to form an adhesive portion containing a single layer of adhesive tape and a non-adhesive portion containing two layers of adhesive tape adhered together.

12. The blank of claim 10, wherein the tab described in (A) is prepared by attaching a strip of adhesive tape to at least one layer of material so as to form an adhesive portion containing a single layer of adhesive tape and a non-adhesive portion containing a layer of adhesive tape adhered to at least one layer of material.

13. The blank of claim 10, wherein the tab described in (A) contains a scored geometric figure which contains a more adherent adhesive than the remaining adhesive on the adhesive portion of the tab.

14. The blank of claim 10, wherein the tab described in (A) is attached to the blank such that, when the box is assembled, the tab will be along a continuation of the joining line of the top.

15. The blank of claim 10, wherein the scored and cut lines described in (B) are located such that, when the box is assembled, the scored and cut lines will be along a continuation of the joining line of the top.

16. The blank of claim 10, wherein the scored lines described in (C) are located such that, when the box is assembled, the scored lines will be along a continuation of the joining line of the top.

17. The blank of claim 10, wherein the hole described in (D) is located such that, when the box is assembled, the hole will be along a continuation of the joining line of the top.

18. In a box, which box contains four sides having upper and lower edges, a bottom, an inside, an outside, and a top having a joining line and containing two inner flaps and two outer flaps, the outer flaps coming into close proximity at the joining line of the top, the improvement comprising an easy-opening means comprising:

A. a tab having an adhesive portion containing adhesive on one side and a non-adhesive portion adhered to a portion of the box which is located on the box where an end of adhesive sealing tape will be located;

B. scored lines and cut lines on the box such that there is at least one scored line having ends, the ends of which are connected by a cut line which are located on the box where an end of adhesive sealing tape will be located, which scored line and cut line will form a tab which will be partially covered by the sealing tape which adheres to the tab so that:

i. the tab may be pushed toward the inside of the box, the adhesive sealing tape may be grasped and pulled to open the box or ii. the tab may be pulled toward the outside of the box, freeing the tab from the box and allowing the pulling of the adhesive sealing tape;

C. scored lines in the box forming a geometric shape which is located on the box where an end of adhesive sealing tape will be located, which geometric shape forms a tab which will be partially covered by the sealing tape which adheres to the tab so that:

i. the tab may be pushed toward the inside of the box and the adhesive sealing tape may be grasped and pulled to open the box or ii. the tab may be pulled toward the outside of the box, freeing the tab from the box and allowing the pulling of the adhesive sealing tape; or D. at least one hole in the box located where an end of adhesive sealing tape will be located and will partially cover the hole, thus allowing the adhesive sealing tape to be grasped and pulled to open the box.

19. The box of claim 18, wherein the tab described in (A) contains a scored geometric figure which contains a more adherent adhesive than the remaining adhesive on the adhesive portion.

20. The box of claim 18, wherein the easy-opening means described in (A) is prepared by i. folding the end of the adhesive tape back upon itself to prepare a non-adhesive portion which is devoid of any exposed adhesive or ii. adhering the end of the adhesive tape to a piece of material which serves as a non-adhesive handle.

* * * * *